US009214298B2

(12) United States Patent
Hsieh

(10) Patent No.: US 9,214,298 B2
(45) Date of Patent: Dec. 15, 2015

(54) BUTTON STRUCTURE FOR ELECTRONIC DEVICE

(71) Applicant: EVERDAY TECHNOLOGY CO., LTD., Yilan County (TW)

(72) Inventor: Shih-Hsiung Hsieh, Yilan County (TW)

(73) Assignee: EVERDAY TECHNOLOGY CO., LTD., Yilan County (TW)

( * ) Notice: Subject to any disclaimer, the term of this patent is extended or adjusted under 35 U.S.C. 154(b) by 65 days.

(21) Appl. No.: 14/198,693

(22) Filed: Mar. 6, 2014

(65) Prior Publication Data

US 2015/0144473 A1 May 28, 2015

(30) Foreign Application Priority Data

Nov. 27, 2013 (TW) ..... 102222233 U

(51) Int. Cl.
*H01H 3/12* (2006.01)
*H01H 13/14* (2006.01)
*H01H 13/02* (2006.01)

(52) U.S. Cl.
CPC ..... *H01H 13/023* (2013.01); *H01H 13/14* (2013.01); *H01H 2221/08* (2013.01)

(58) Field of Classification Search
CPC .. H01H 13/023; H01H 13/14; H01H 2221/08
USPC ..... 200/341
See application file for complete search history.

(56) References Cited

U.S. PATENT DOCUMENTS 6,964,532 B1 * 11/2005 Lu ..... 400/490
7,105,760 B2 * 9/2006 Zensai ..... 200/341

* cited by examiner

*Primary Examiner* — Renee Luebke
*Assistant Examiner* — Lheiren Mae A Caroc
(74) *Attorney, Agent, or Firm* — Li & Cai Intellectual Property (USA) Office

(57) ABSTRACT

A button structure is provided for installing to a casing of an electronic device having a button opening. The button structure is flexible and comprises an engaging portion, a button portion, a first alignment portion, a second alignment portion and a hollow sleeve. The engaging portion is disposed at a fixing end of the button structure. The button structure is connected to the inward side of the casing through the engaging portion. The button portion is disposed at a free end of the button structure for aligning with the button opening of the casing. The button portion has a light guiding portion for neighboring to a light emitting diode. The first alignment portion and the second alignment portion are mounted on a first protrusion portion and a second protrusion portion of the casing respectively. The hollow sleeve is disposed axially movably to the fixing sleeve of the casing.

7 Claims, 5 Drawing Sheets

BUTTON STRUCTURE FOR ELECTRONIC DEVICE

BACKGROUND OF THE INVENTION

1. Field of the Invention

The instant disclosure relates to a button structure; in particular, to a button structure for an electronic device.

2. Description of Related Art

The electronic device usually has at least one button for manually controlled by the user. In manufacturing, the button structure usually is designed with the casing of the electronic device in order to provide convenient, practical and aesthetic functions. Some kinds of button structures have a light guiding portion, thus the button may be easily identified by the user at night or without ambient light. Usually, the button structure may be a flexible structure, a deformable mechanism, or a moveable mechanism, thus the button includes a not pressed state and a pressed state, meanwhile the button could change between these two states.

In order to make the button have multiple functions and advantages, such as the simple structure, low manufacturing cost, light-emitting effect . . . etc., the manufacturers usually make the button be integrally molded. However, in order to assemble the button with the casing of the electronic device, the thermal fusion wielding technology is utilized to make the button be fastened on the casing. Although the manufacturing and assembling method is simple, the working hour of assembling the button with the casing of the electronic device is hard to be cut down. Thus, it may spend much assembly time for the electronic device.

SUMMARY OF THE INVENTION

The object of the instant disclosure is to provide a button structure for an electronic device. The button structure has a simple structure and is easy to assemble for reducing related manufacturing costs.

In order to achieve the aforementioned objects, according to an embodiment of the instant disclosure, a button structure for an electronic device is offered. The button structure is for installing to a casing of the electronic device, the casing has a button opening. The button structure is flexible. The button structure comprises an engaging portion, a button portion, a first alignment portion, a second alignment portion and a hollow sleeve. Then engaging portion is disposed at a fixing end of the button structure. The engaging portion engages with the casing. The button structure is connected to the inward side of the casing through the engaging portion. The button portion is disposed at a free end of the button structure and aligned with the button opening of the casing. The button portion has a light guide portion for neighboring to a light emitting diode. The first alignment portion is mounted on a first protrusion portion of the casing. The second alignment portion is mounted on a second protrusion portion of the casing. The hollow sleeve is disposed axially movably to a fixing sleeve of the casing.

In summary, the button structure for the electronic device is flexible, the button structure is fastened to the inward side of the casing of the electronic device through the engaging portion, and the user could press the button structure. The button structure could be stably fastened to the inward side of the casing through the hollow sleeve when the user presses the button structure. It does not need to utilize the thermal fusion wielding technology in order to assemble the button structure with the casing of the electronic device. Therefore, the assembling time of the button structure could be greatly saved.

In order to further the understanding regarding the instant disclosure, the following embodiments are provided along with illustrations to facilitate the disclosure of the instant disclosure.

DETAILED DESCRIPTION OF THE PREFERRED EMBODIMENTS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

[An Embodiment of a Button Structure for an Electronic Device]

Figure 1A:
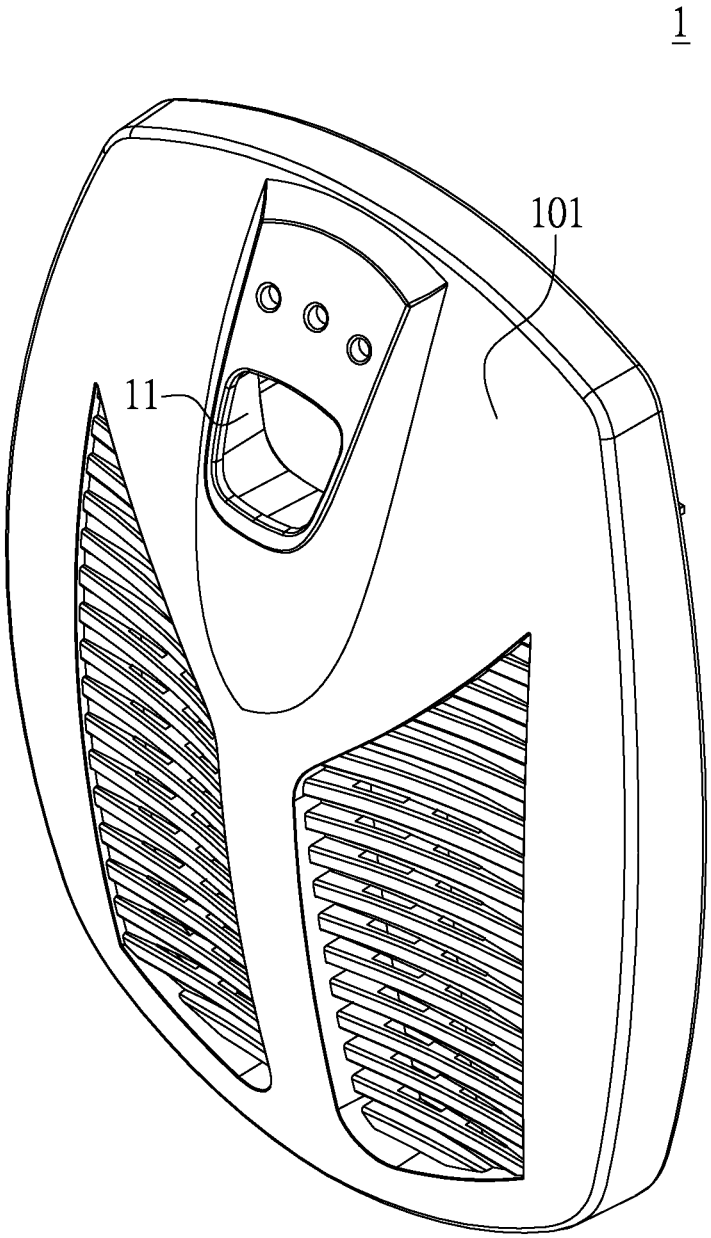
FIG. 1A shows a front view of a casing of the electronic device according to an embodiment of the instant disclosure.
Figure 1B:
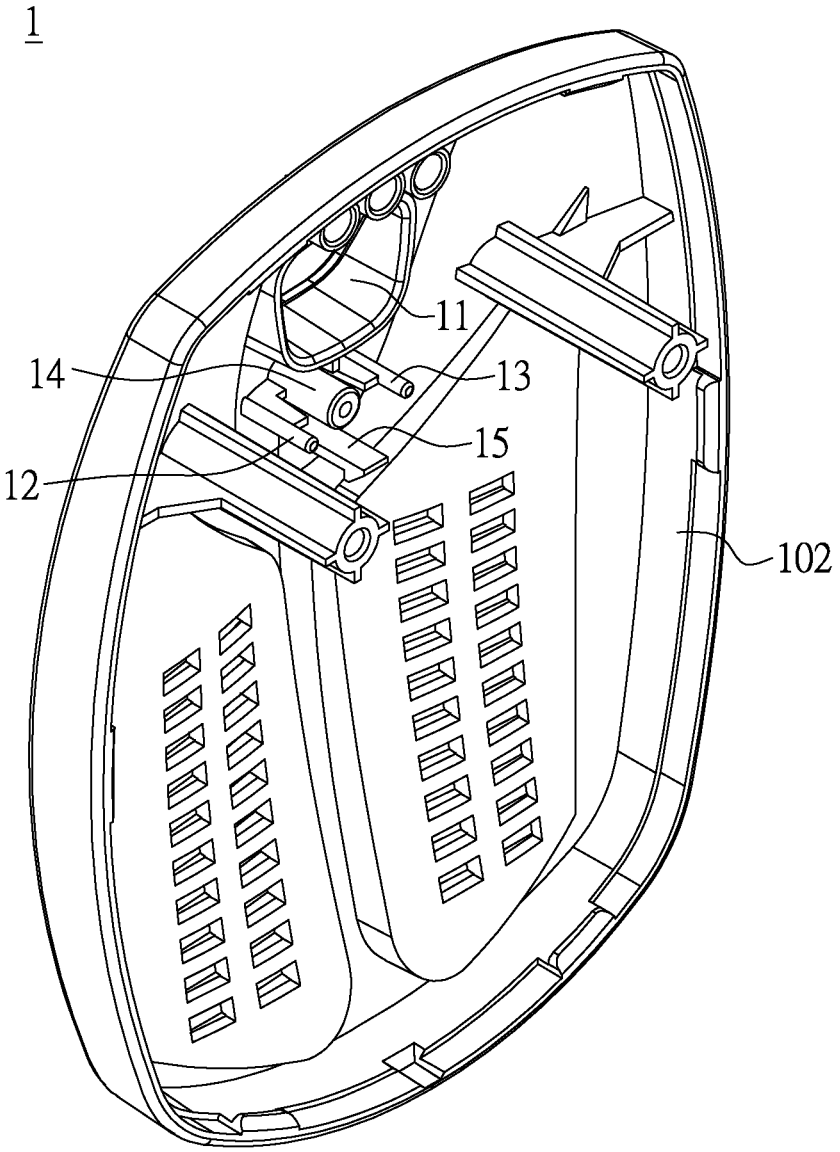
FIG. 1B shows a back view of a casing of the electronic device according to an embodiment of the instant disclosure.

Please refer to FIG. 1A in conjunction with FIG. 1B, FIG. 1A shows a front view of a casing of the electronic device according to an embodiment of the instant disclosure, FIG. 1B shows a back view of a casing of the electronic device according to an embodiment of the instant disclosure. The electronic device may be an alarm device or a detector. The casing 1 of the electronic device has an outward side 101 and an inward side 102, and a button opening 11 of the casing 1 is aligned with a button portion of a button structure. The inward side 102 of the casing 1 has a first protrusion portion, a second protrusion portion 12, a fixing sleeve 14 and an engaging member 15, as shown in FIG. 1B.

Figure 2A:
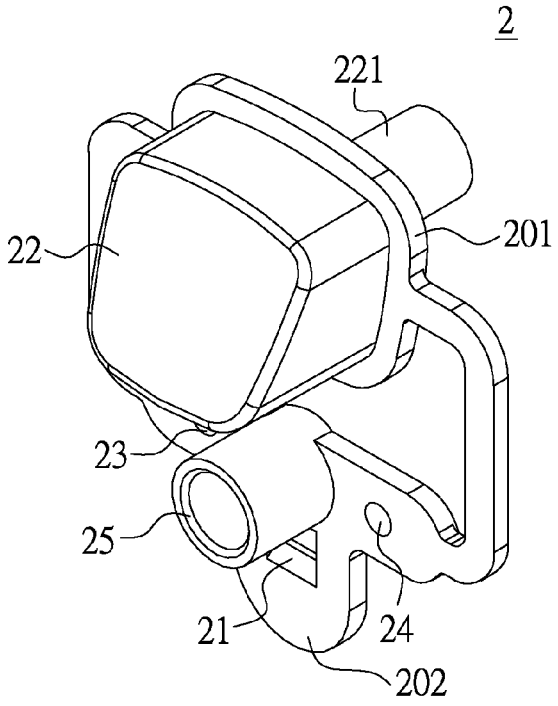
FIG. 2A shows a front view of a button structure according to an embodiment of the instant disclosure.
Figure 2B:
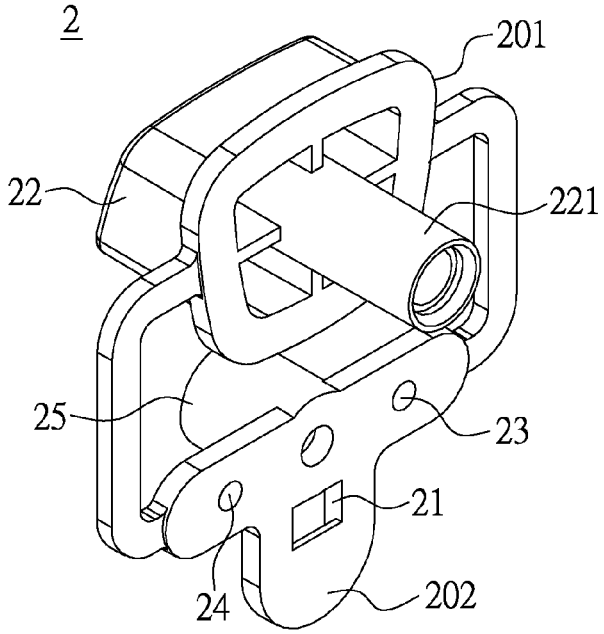
FIG. 2B shows a back view of a button structure according to an embodiment of the instant disclosure.

Please refer to FIG. 1B in conjunction with FIG. 2A and FIG. 2B, FIG. 2A shows a front view of a button structure according to an embodiment of the instant disclosure, FIG. 2B shows a back view of a button structure according to an embodiment of the instant disclosure. The button structure 2 is for installing to the casing 1 of the electronic device. The button structure 2 is flexible may by plastic or acrylic for example. The button structure 2 may be translucent or semi-translucent, for example, an integral translucent or semi-translucent plastic (or acrylic) structure. The casing 1 of the electronic device is configured corresponding to the button structure 2 shown in FIGS. 2A and 2B. Specifically, the button structure 2 comprises an engaging portion 21, a button portion 22, a first alignment portion 23, a second alignment portion 24 and a hollow sleeve 25. The button structure 2 has two ends, in which one end is a free end 201 and another end is a fixing end 202. The free end 201 may be moved due to manually pressing made by the user. The fixing end 202 is for engaging with the inward side 102 of the casing 1, thus the fixing end 202 may be motionless. The shape of the button structure 2, the shapes and the relative positions of the engaging portion 21, the button portion 22, the first alignment portion 23, the second alignment portion 24 and the hollow sleeve 25 shouldn't be the limitation to the present invention.

Please also note that the following embodiments are in order to describe the instant disclosure in an understandable and clear way.

Figure 3:
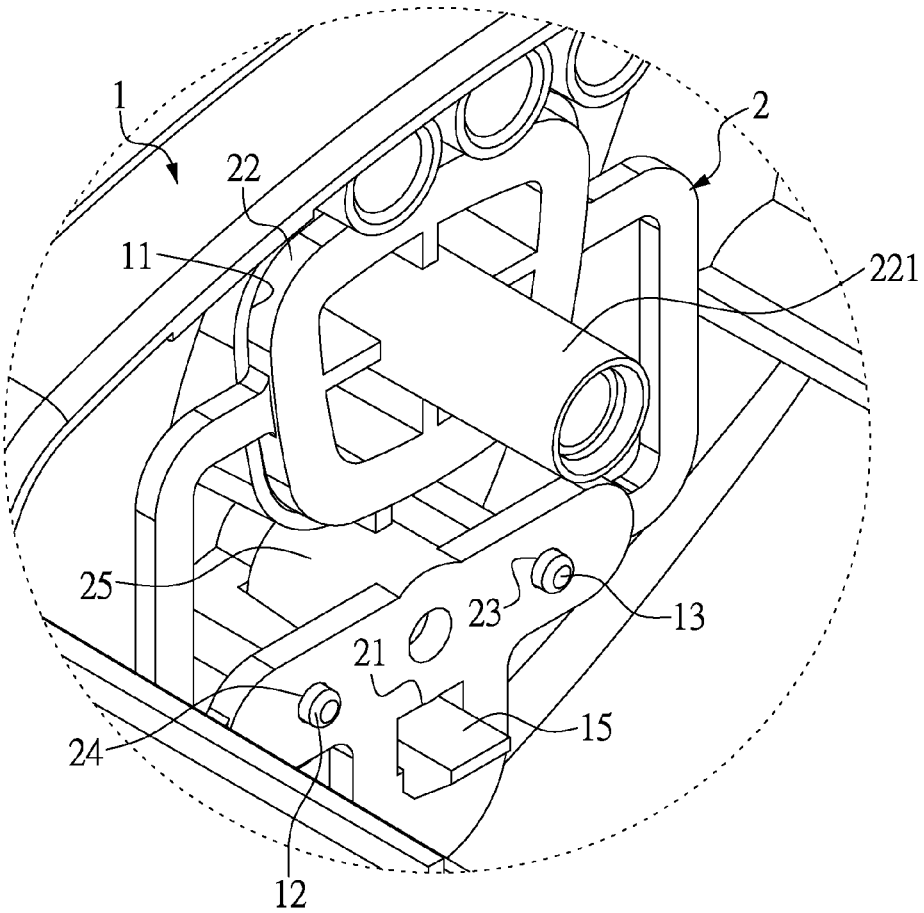
FIG. 3 shows an assembly drawing of a button structure and a casing of the electronic device according to an embodiment of the instant disclosure.

Please refer to FIG. 2A in conjunction with FIG. 2B and FIG. 3, FIG. 3 shows an assembly drawing of a button structure and a casing of the electronic device according to an embodiment of the instant disclosure. Then engaging portion 21 is disposed at the fixing end 202 of the button structure 2. The engaging portion 21 engages with the casing 1. The button structure 2 is connected to the inward side 102 of the casing 1 through the engaging portion 21. In one embodiment, the engaging portion 21 is a slot, as shown in FIG. 2A and FIG. 2B, the slot is engaged with the engaging member 15 of the casing 1. The slot and the engaging member may be exchanged. For example, in another embodiment, the engaging portion 21 is an engaging member for engaging with a slot of the casing 1. In other words, the engaging portion 21 could be easily fixed to the inward side 102 of the casing 1. The assembling operator of the button structure 2 only needs to directly join the engaging portion 21 to the engaging member 15 or slot of the casing 1, meanwhile the assembly is completed accordingly. It does not need to utilize the thermal fusion wielding technology in order to assemble the button structure 2 with the electronic device. Therefore, the assembling time of the button structure 2 could be greatly saved.

It is worth mentioning that the engaging portion 21 is only for fastening the fixing end 202 of the button structure 2, meanwhile the free end 201 of the button structure 2 is not fixed. Specifically, the button portion 22 is disposed at the free end 201 of the button structure 2 and aligned with the button opening 11 of the casing 1. The button portion 22 has a light guide portion 221 for neighboring to a light emitting diode (not shown in the figure). For example, the light guide portion 221 is a light guide plate, a light guide bar or a light pipe. As shown in FIG. 2B, the light guide portion 221 is a light pipe. The button portion 22 aligned with the button opening 11 of the casing 1 is not fixed, thus the button portion 22 could move toward the inward side 102 of the casing 1 when the user presses the button portion 22. Specifically, the button structure 2 is an elastic body, and the free end 201 of the button structure 2 would perform a motion relative to the fixing end 202 when a force is large enough to deform the button structure 2. That is, the button portion 22 at the free end 201 would perform a small rotation about a fulcrum which is the engaging portion 21 at the fixing end 202.

Furthermore, the first alignment portion 23 is mounted on a first protrusion portion 13 of the casing 1. The second alignment portion 24 is mounted on a second protrusion portion 12 of the casing 1. The first alignment portion 23 and the second alignment portion 24 are both for positioning while installing the button structure 2 to the casing 1, such that the operator could perform the assembly more easily. In other word, when the operator needs to assemble the button structure 2, the operator only needs to align the engaging portion 21 with the engaging member 15 of the casing 1, and then align the button portion 22 with the button opening 11 of the casing. Accordingly, the roughly positioning of the button structure 2 is completed. In order to make the engaging portion 21 be aligned with the engaging member 15 of the casing 1 fast and accurately with an offset error as small as possible, the first alignment portion 23 is aligned with the first protrusion portion 13, and the second alignment 24 is aligned with the second protrusion portion 12. Thus, the operator could position the button structure 2 more preciously for engaging the button structure 2 through the engaging portion 21. In this embodiment, as shown in FIG. 2A and FIG. 2B, the first alignment portion 23 and the second alignment portion 24 are respectively placed at two opposite sides of the hollow sleeve 25.

Furthermore, the hollow sleeve 25 is disposed axially movably to the fixing sleeve 14 of the casing 1. In one embodiment, the hollow sleeve 25 is disposed axially movably to the outside wall of the fixing sleeve 14 of the casing 1, as shown in FIG. 3. That is, the inner radius of the hollow sleeve 25 is larger than the outer radius of the fixing sleeve 14 of the casing 1, so as to make the hollow sleeve 25 could sleeve the outside wall of the fixing sleeve 14. A small gap between the inner wall of the hollow sleeve 25 and the outer wall of the fixing sleeve 14 could be designed, in order to make the assembly be quick and easy. Meanwhile, the designed small gap could not make the first alignment portion 23 and the second alignment portion 24 deviate from the first protrusion portion 13 and the second protrusion portion 12. Therefore, the movement (or slight rotation) of the free end 201 of the button structure 2 is restricted by the combination of the hollow sleeve 25 and the fixing sleeve 14. In other words, the hollow sleeve 25 could substantially axially move along the fixing sleeve 14, and the movement of the free end 201 of the button structure 2 is not parallel to the axial of the movement of the hollow sleeve 25 along the fixing sleeve 14, thus the movement of the free end 201 is restricted to the contact surface(s) between the hollow sleeve 25 and the fixing sleeve 14. Thus, the button structure 2 would not be displaced due to the deformation of itself. When the user stops pressing the button structure 22, the button structure 2 intends to restore its original shape due to the elasticity.

In another embodiment, the inner radius and the outer radius of the hollow sleeve 25 may be smaller than the outer radius of the fixing sleeve 14, thus the hollow sleeve 25 could be disposed axially movably to the inside wall of the fixing sleeve 14 of the casing 1. In other words, the hollow sleeve 25 and the fixing sleeve 14 could be exchanged according to the design in practical applications.

Please refer to FIG. 2A again. In order to assist to prevent the button structure 2 leaving the installed position on the inward side 102 of the casing 1, the hollow sleeve 25 may be designed near to a straight line defined by the engaging portion 21 and the button portion 42. In this embodiment, the engaging portion 21, the button portion 22 and the hollow sleeve 25 are arranged along a straight line, but the present invention is not so restricted. Additionally, in this embodiment, the straight line defined by the first alignment portion 23 and the second alignment portion 24 may be perpendicular to the straight line defined by the engaging portion 21 and the button structure 22, but the present invention is not restricted thereto. The positions of the first alignment portion 23 and the second alignment portion 24 may be changed according to the design in practical applications, as long as the first alignment portion 23 and the second alignment portion 24 could be positioned according to the first protrusion portion 13 and the second protrusion portion 12. Additionally, in this embodiment, the hollow sleeve 25 is disposed at the intersection of the line defined by the first alignment portion 23 and the second alignment portion 24 and the straight line defined by the engaging portion 21 and the button portion 22.

[Another Embodiment of a Button Structure for an Electronic Device]

Figure 4:
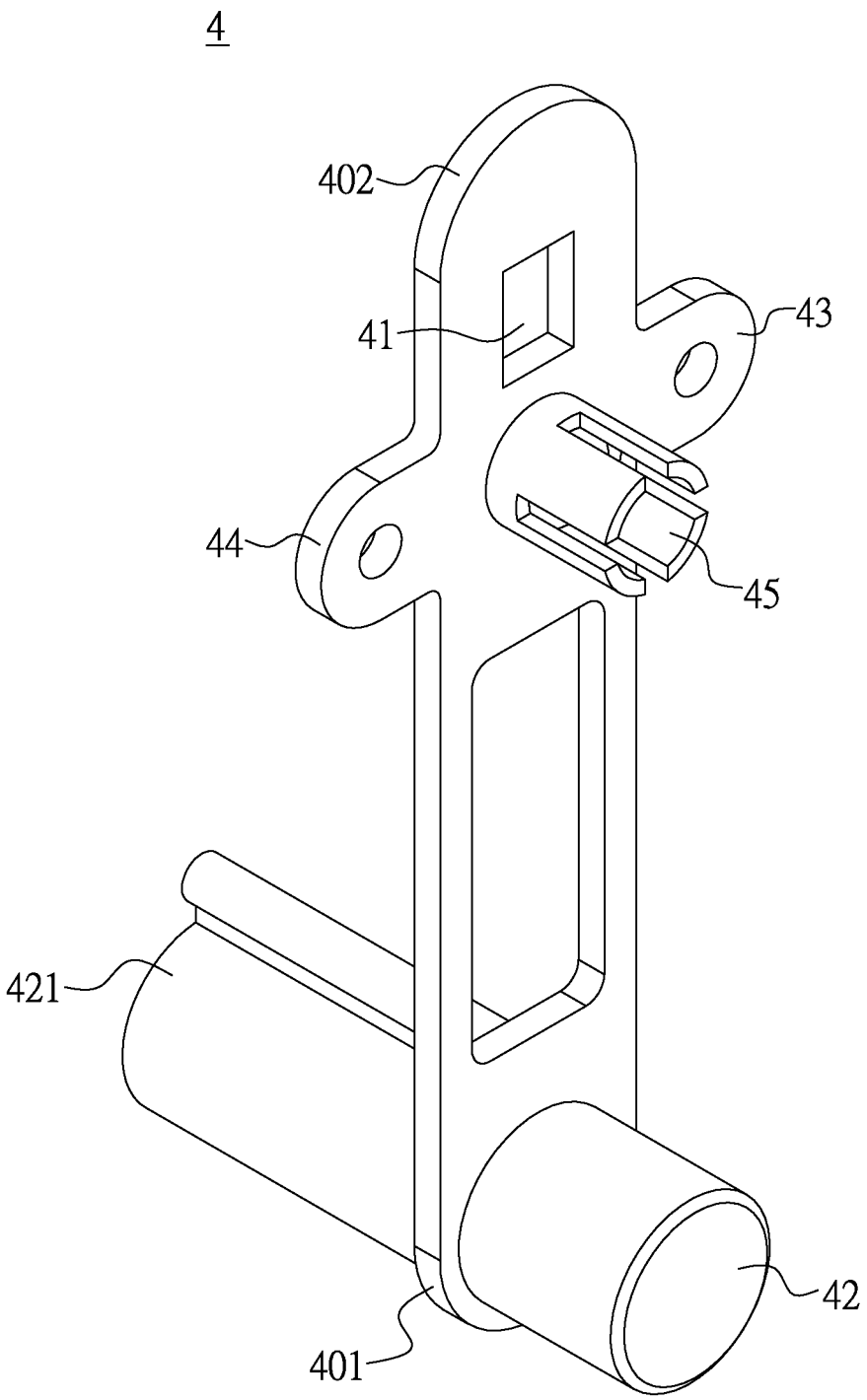
FIG. 4 shows a schematic diagram of a button structure according to another embodiment of the instant disclosure.

Please refer to FIG. 4 showing a schematic diagram of a button structure according to another embodiment of the instant disclosure. The button structure 4 is for installing to the casing of the electronic device (not shown in the figure), wherein the casing has an opening portion. As the previous embodiment, the casing of the electronic device is designed corresponding to the button structure 4 shown in FIG. 4. The button structure 4 is flexible, and comprises an engaging portion 41, a button portion 42, a first alignment portion 43, a second alignment portion 44 and a hollow sleeve 45. The engaging portion 41 is disposed at a fixing end 402 of the button structure 4. The engaging portion 41 engages with the casing, the button structure 4 is connected to the inward side of the casing through the engaging portion 41. The button portion 42 is disposed at a free end 401 of the button structure 4 and aligned with the button opening of the casing. The button portion 42 has a light guide portion 421 for neighboring to a light emitting diode. The first alignment portion 42 is mounted on a first protrusion portion of the casing. The second alignment portion 44 is mounted on a second protrusion portion of the casing. The hollow sleeve 45 is disposed axially movably to the fixing sleeve of the casing. The structure of the button structure 4 in this embodiment is significantly identical to the button structure 2 in the previous embodiment except for differences specified in the follows. The shape of the button structure and the relative positions of each component are altered, other technical features could be referred to the previous embodiment, thus the redundant information is not repeated.

According to above descriptions, the button structure for the electronic device is flexible, the button structure is fastened to the inward side of the casing of the electronic device through the engaging portion, and the user could press the button structure. The button structure could be stably fastened to the inward side of the casing through the hollow sleeve when the user presses the button structure. It does not need to utilize the thermal fusion wielding technology in order to assemble the button structure with the casing of the electronic device. Therefore, the assembling time of the button structure could be greatly saved.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A button structure for an electronic device, for installing to a casing of the electronic device, the casing having a button opening, the button structure being flexible, the button structure comprising:

an engaging portion, disposed at a fixing end of the button structure, the engaging portion engaging with the casing, the button structure connected to the inward side of the casing through the engaging portion;

a button portion, disposed at a free end of the button structure and aligned with the button opening of the casing, the button portion having a light guide portion for neighboring to a light emitting diode;

a first alignment portion, mounted on a first protrusion portion of the casing;

a second alignment portion, mounted on a second protrusion portion of the casing; and a hollow sleeve, being disposed axially movably to a fixing sleeve of the casing, wherein the first alignment portion and the second alignment portion are respectively disposed at opposite sides of the hollow sleeve, a first straight line defined by the first alignment portion and the second alignment portion is perpendicular to a second straight line defined by the engaging portion and the button portion;

wherein the hollow sleeve is disposed at the intersection of the first straight line and the second straight line.

2. The button structure for an electronic device according to claim 1, wherein the hollow sleeve is disposed axially movably to an outside wall of the fixing sleeve of the casing.

3. The button structure for an electronic device according to claim 1, wherein the hollow sleeve is disposed axially movably to an inside wall of the fixing sleeve of the casing.

4. The button structure for an electronic device according to claim 1, wherein the engaging portion, the button portion and the hollow sleeve are arranged along a straight line.

5. The button structure for an electronic device according to claim 1, wherein the button structure is an integrally formed structure.

6. The button structure for an electronic device according to claim 1, wherein the engaging portion is a slot, the slot is engaged to an engaging member of the casing.

7. The button structure for an electronic device according to claim 1, wherein the engaging portion is an engaging member, the engaging member is engaged to a slot of the casing.

* * * * *